US012479618B2

(12) United States Patent
Torre

(10) Patent No.: US 12,479,618 B2
(45) Date of Patent: Nov. 25, 2025

(54) PACKAGING MACHINE

(71) Applicant: MINIPACK-TORRE S.P.A., Dalmine (IT)

(72) Inventor: Fabio Emanuele Torre, Dalmine (IT)

(73) Assignee: MINIPACK-TORRE S.P.A., Dalmine (IT)

( * ) Notice: Subject to any disclaimer, the term of this patent is extended or adjusted under 35 U.S.C. 154(b) by 0 days.

(21) Appl. No.: 18/563,030

(22) PCT Filed: Apr. 28, 2022

(86) PCT No.: PCT/IT2022/050114

§ 371 (c)(1),
(2) Date: Nov. 21, 2023

(87) PCT Pub. No.: WO2022/249208

PCT Pub. Date: Dec. 1, 2022

(65) Prior Publication Data

US 2024/0239543 A1 Jul. 18, 2024

(30) Foreign Application Priority Data

May 28, 2021 (IT) ..... 102021000014045

(51) Int. Cl.
*B65B 67/10* (2006.01)
*B65B 11/50* (2006.01)
(Continued)

(52) U.S. Cl.
CPC ..... *B65B 67/10* (2013.01); *B65B 11/50* (2013.01); *B65B 31/00* (2013.01); *B65B 41/12* (2013.01);
(Continued)

(58) Field of Classification Search
CPC ..... B65B 67/08; B65B 67/085; B65B 67/10; B65B 41/12; B65B 45/00; B65B 59/001; B65B 11/50; B65B 2210/04
See application file for complete search history.

(56) References Cited

U.S. PATENT DOCUMENTS 3,006,122 A * 10/1961 Weishans ..... B65B 9/06 156/251
3,067,553 A * 12/1962 Rivman ..... B65B 9/06 53/550
(Continued)

FOREIGN PATENT DOCUMENTS

CN 106742305 A 5/2017
CN 109178490 A 1/2019
(Continued)

OTHER PUBLICATIONS

Written Opinion of the International Searching Authority dated Sep. 2, 2022.

*Primary Examiner* — Joshua G Kotis
(74) *Attorney, Agent, or Firm* — Jacob M. Ward; Ward Law Office LLC

(57) ABSTRACT

A packaging machine is described comprising: support means for at least two reels of wrapping material in plastic film, film opening means for wrapping a product to be packaged, a support, fixed or mobile, on which the product to be packaged is placed, sealing means of the film configured to seal two edges of the film and cutting means for the film so as to create a package for the product starting from a reel of single-folded material, wherein the film opening means comprise a film opening plate, arranged between the reel and the welding and/or cutting means, comprising at least two surfaces connected to each other at a first end located near the reel and spaced in the film unwinding direction to create the package, facing an operator so as to
(Continued)

move the two edges away in the direction of the operator, enabling the creation of the packaging.

9 Claims, 3 Drawing Sheets

(51) Int. Cl.

| | |
|---|---|
| ***B65B 31/00*** | (2006.01) |
| ***B65B 41/12*** | (2006.01) |
| ***B65B 45/00*** | (2006.01) |
| ***B65B 51/14*** | (2006.01) |
| ***B65B 53/02*** | (2006.01) |
| ***B65B 59/00*** | (2006.01) |
| ***B65B 61/00*** | (2006.01) |

(52) U.S. Cl.
CPC ..... *B65B 45/00* (2013.01); *B65B 51/14* (2013.01); *B65B 53/02* (2013.01); *B65B 59/001* (2019.05); *B65B 61/005* (2013.01); *B65B 2210/04* (2013.01)

(56) References Cited

U.S. PATENT DOCUMENTS 3,128,584 A * 4/1964 Muskat ..... B65B 9/06 53/553
3,195,289 A * 7/1965 Cochrane ..... B65B 25/20 53/562
3,239,993 A * 3/1966 Cherrin ..... B65B 9/06 493/203
3,254,551 A * 6/1966 Uvodich ..... B65B 67/10 83/171
3,327,451 A * 6/1967 Forman ..... B65B 61/005 53/568
3,347,729 A * 10/1967 Seefluth ..... B29C 66/73921 219/769
3,420,034 A * 1/1969 Saraisky ..... B29C 66/8221 53/526
3,429,100 A * 2/1969 Monaghan ..... B65B 9/06 53/385.1
3,496,700 A * 2/1970 Eugene ..... B65B 53/063 53/550
3,815,317 A * 6/1974 Toss ..... B65B 9/2028 493/203
4,104,848 A * 8/1978 Torre ..... B65B 51/14 53/557
4,162,604 A * 7/1979 Bartolomei ..... B65B 51/148 219/400
4,177,622 A * 12/1979 Siegel ..... B65B 31/04 53/511
4,185,443 A * 1/1980 Budzyn ..... B65B 9/06 53/550
4,419,854 A * 12/1983 Okada ..... B65B 9/13 53/512
4,495,751 A * 1/1985 Galbiati ..... B65B 9/15 53/581
4,545,181 A * 10/1985 Frankefort ..... B65C 3/065 53/565
4,667,456 A * 5/1987 Raffault ..... B65B 9/073 53/442
4,697,401 A * 10/1987 Kessler ..... B29C 66/244 53/201
5,235,792 A * 8/1993 Hanagata ..... B65B 61/00 53/568
5,381,644 A * 1/1995 Di Bernardo ..... B65B 9/073 53/511
5,537,798 A * 7/1996 Fukuda ..... B65B 59/003 53/201
11,505,356 B2 * 11/2022 Van Rijsewijk ..... B65C 3/065
2004/0060264 A1 * 4/2004 Miller ..... B65B 11/18 53/461
2010/0242418 A1 * 9/2010 Thurgood ..... B65B 9/073 53/562
2017/0349312 A1 * 12/2017 Lazor ..... B65B 59/001
2019/0344510 A1 * 11/2019 Mcgreevey ..... B29C 66/872

FOREIGN PATENT DOCUMENTS

EP 2123564 A2 * 11/2009 ..... B65B 53/066
IT MI20121274 A1 1/2014
WO 2018144520 A1 8/2018

* cited by examiner

PACKAGING MACHINE

CROSS-REFERENCE DATA

This application is a National Stage of International Application No. PCT/IT2022/050114, filed Apr. 28, 2022, which in turn claims the benefit of Italian Patent Application No. 102021000014045, filed May 28, 2021. The entire disclosures of the above applications are incorporated herein by reference.

BACKGROUND OF THE INVENTION

Field of the Invention

The present invention refers to a packaging machine, in particular to a manual packaging machine.

Background Art

Packaging machines are known in the art which are commonly equipped with: a reel for feeding a plastic film, in particular a single-folded film, means for opening the single-folded film to wrap a product to be packaged, a support, fixed or mobile, on which the product to be packaged is placed, sealing means and cutting means for the film configured to seal the open sides of the folded film and cut it to create a package for the product.

These known packaging machines have the problem that, while allowing to create packages with variable dimensions starting from a single reel of single-folded film, they do not allow to optimize the reel dimensions or the type of material used to make the package.

SUMMARY OF THE INVENTION

Object of the present invention is providing a packaging machine that allows the simultaneous use of reels of different sizes or materials, which allows the user to create packages at the very moment of need, choosing the dimensions and/or the most suitable material for the product that must be packaged.

Another object of the present invention is providing a packaging machine that allows the operator to use the reel of material most suited to the characteristics of the product to be packaged, and that avoids the need to replace the reels or to use two different machines loaded with different reels, but allows choosing at the time of need the material to make the package using a single packaging machine, with savings in time, costs and overall dimensions of the envelope system.

The aforementioned and other objects and advantages of the invention, which will emerge from the following description, are achieved with a packaging machine. Preferred embodiments and non-trivial variants of the present invention are the subject matter of the dependent claims.

It is understood that all attached claims are an integral part of the present description.

It will be immediately obvious that innumerable variations and modifications (for example relating to shape, dimensions, arrangements and parts with equivalent functionality) can be made to what is described, without departing from the scope of the invention as appears from the attached claims.

BRIEF DESCRIPTION OF THE DRAWINGS

The present invention will be better described by a preferred embodiment, provided by way of non-limiting example, with reference to the attached drawings, in which.

DETAILED DESCRIPTION OF PREFERRED EMBODIMENTS

Figure 1:
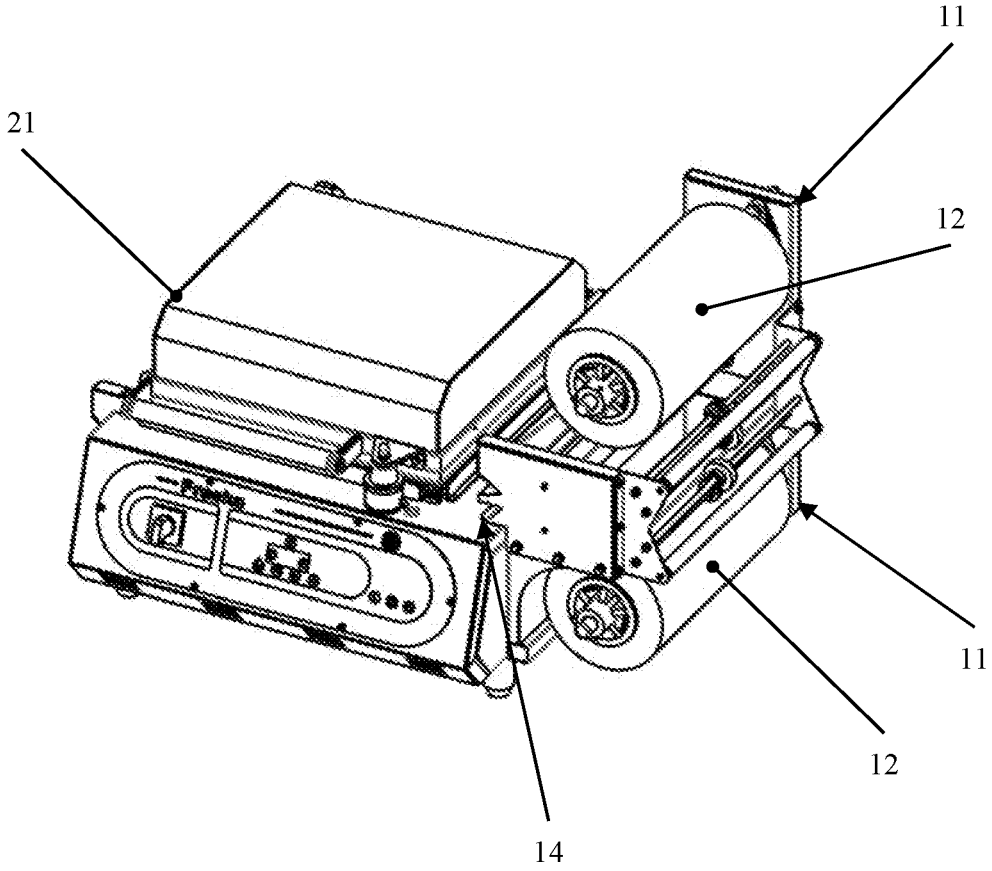
FIG. 1 shows a perspective view of a preferred embodiment of the packaging machine according to the present invention.
Figure 2:
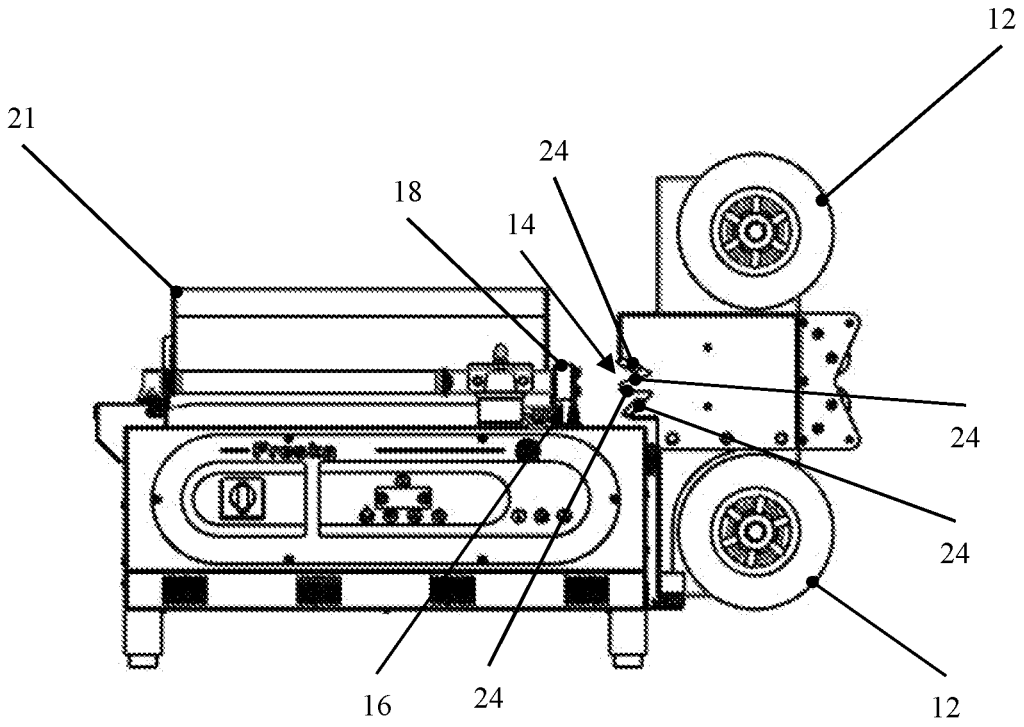
FIG. 2 shows a front view of the packaging machine according to the present invention.
Figure 3:
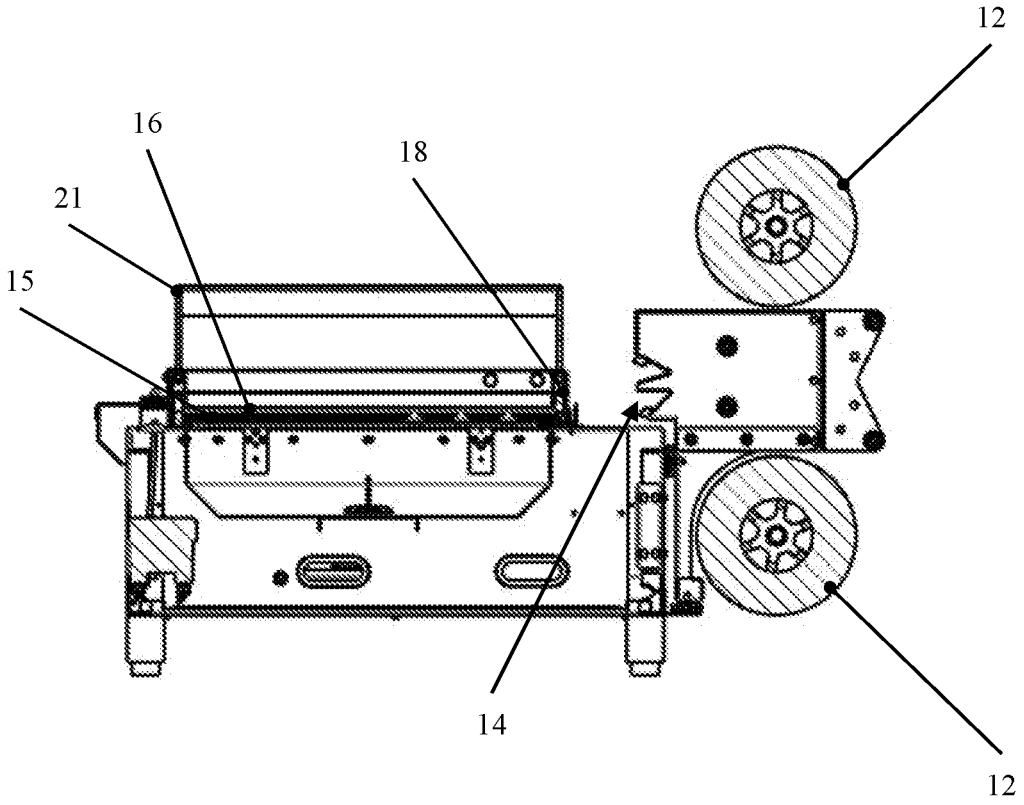
FIG. 3 shows a front sectional view of the packaging machine according to the present invention.

With reference to the Figures, a preferred embodiment of the packaging machine 10 according to the present invention is described.

In the continuation of the description, for obvious reasons of brevity, all structural and operating details of the packaging machine known and belonging to the state of the art will be omitted.

As shown in the Figures, the packaging machine 10 according to the present invention comprises: means 11 for supporting at least two reels 12 of wrapping material including plastic or non-plastic film, preferably single-folded film, means for opening the film 14 for wrapping a product to be packaged, a fixed or movable support surface 15 on which the product to be packaged is placed, film sealing means 16 configured to seal two edges of the film and cutting means 18 for the film so as to create a package for the product starting from a reel 12 of single-folded material.

The film opening means 14 are arranged between the reels 12 and the sealing means 16 and/or the film cutting means 18 and are configured to space the two edges of the folded film apart so as to allow the introduction of a product to be packaged between the two edges; preferably, the film opening means comprise a film-opening plate 14, arranged between the reel and the welding and/or cutting means, comprising at least two surfaces 24 connected to each other at a first end located near the reel 12 and spaced in the direction of unwinding of the film for the creation of the package, facing an operator so as to move the two edges away in the direction of the operator, facilitating the creation of the package; preferably, the film opening means 14 comprise two surfaces 24 near each reel which can be made in a single film-opener sheet or in two separate sheets, for example by bending the sheet.

Preferably, the support means 11 of the at least two reels 12 of plastic film wrapping material are arranged so as to support two reels 12 placed one above the other, and the film opening means 14 are interposed between the two reels 12; preferably, the support means 11 of the reels 12 comprise first support means for a first upper reel and second support means for a second lower reel.

The film sealing means 16 comprise at least one heating element, preferably associated with a lever sealing arm or a bell lid 21, configured to close on the product to be packaged, of the automatic or manual type, to seal two edges of the folded film and form the product packaging; preferably, the sealing means 16 are placed downstream of the film-opening plate 14, in the film unwinding direction.

The cutting means 18 are preferably arranged in correspondence with the sealing means 16 of the film to cut the film of single-folded material once the package has been made.

In a known way, the packaging machine 10 of the invention comprises an electronic control unit comprising a microprocessor, memory means and a timer for selecting the film sealing time and heat-shrinking time.

In the operation of the packaging machine 10 according to the invention, the at least two reels 12 of single-folded film are placed on the reel holder support means 11 with the flap opened frontally towards the operator. The two edges of the single-folded film of the reel 12 chosen by the operator are passed through the opening means 14 of the film. The operator's hand, with or without the product to be packaged, is inserted inside the two edges of the film of the reel 12, away from the respective film opening means 14, in particular from the film opener plate, while the film is unwound from the reel 12 for the length necessary for the package and made rest on the support surface.

The film sealing means 16 are operated, for example by lowering the lever sealing arm or the bell lid 21, for the set time necessary to seal the edges of the film; once the sealing is complete, the package is cut with the cutting means 18.

The packaging machine 10 of the invention may also comprise a vacuum packaging device or a device for the use of heat-shrinkable or paper material.

Advantageously, the packaging machine of the invention allows the simultaneous use of reels of different sizes or materials, and allows creating packages at the very moment of need, by choosing the most suitable size and/or material for the product to be packaged.

Some preferred embodiments of the invention have been described, but of course they are susceptible to further modifications and variations within the same inventive idea. In particular, numerous variations and modifications, functionally equivalent to the preceding ones, which fall within the scope of the invention as highlighted in the attached claims, will be immediately evident to those skilled in the art.

I claim:

1. A packaging machine for wrapping a product to be packaged, comprising:

a support means for at least two reels of wrapping material including plastic or non-plastic film, a film opening means, a support surface, fixed or mobile, on which the product to be packaged is placed, a sealing means of the film configured to seal two edges of the film, and a cutting means for the film in order to create a package for the product starting from a reel, of the at least two reels, of single-folded material, wherein:

the film opening means comprises a film-opening plate, arranged between the at least two reels and the sealing and/or the cutting means, the film-opening plate comprising two surfaces adjacent to and corresponding to each reel of the at least two reels, wherein the two surfaces are connected to each other at a first end located adjacent the corresponding reel and, the two surfaces are spaced apart such that the two surfaces diverge in a film unwinding direction, so as to move the two edges away from one another to allow the introduction of a product between the two edges, enabling the production of the package, and the machine enables the simultaneous use of the at least two reels of different sizes and/or materials, facilitating on-demand selection of package dimensions and/or material based on characteristics of the product to be packaged.

2. The packaging machine of claim 1, wherein the film opening means are arranged between the reels and the sealing means and/or the cutting means of the film and are configured to space the two edges of the single-folded film apart so as to allow the introduction of a product to be packaged between the two edges.

3. The packaging machine of claim 1, wherein the two surfaces are constructed of either a single sheet or two separate sheets.

4. The packaging machine of claim 1, wherein the support means of the at least two reels of wrapping material including plastic or non-plastic film is arranged so as to support two reels placed one above the other, and the film opening means are interposed between the two reels.

5. The packaging machine of claim 4, wherein the support means of the reels comprise first support means for a first upper reel and second support means for a second lower reel.

6. The packaging machine of claim 1, wherein the sealing means of the film comprise at least one heating element associated with a lever-operated sealing arm or with a bell lid, of an automatic or manual type, configured to close on the product to be packaged, to seal two edges of the single-folded film and form the product package.

7. The packaging machine of claim 6, wherein the sealing means are placed downstream of the film-opening plate, in the film unwinding direction.

8. The packaging machine of claim 1, wherein the cutting means are arranged in correspondence with the sealing means of the film to cut the film of folded material once the package has been made.

9. The packaging machine of claim 1, including a vacuum packaging device.

* * * * *